United States Patent [19]

Kyytsönen

[11] Patent Number: 4,637,566

[45] Date of Patent: Jan. 20, 1987

[54] METHOD AND APPARATUS FOR CONDUCTING THE END OF A WEB

[75] Inventor: Markku Kyytsönen, Numminen, Finland

[73] Assignee: Oy Wartsila AB, Finland

[21] Appl. No.: 772,682

[22] Filed: Sep. 5, 1985

[30] Foreign Application Priority Data

Sep. 7, 1984 [FI] Finland ..... 843526

[51] Int. Cl.[4] ..... B65H 18/16; B65H 20/16; B65H 27/00

[52] U.S. Cl. ..... 242/56 R; 226/92; 242/66; 242/76

[58] Field of Search ..... 242/55, 66, 76, 195, 242/56 R; 226/92

[56] References Cited

U.S. PATENT DOCUMENTS

| | | | |
|---|---|---|---|
| 2,277,319 | 3/1942 | Greenberger | 226/92 |
| 2,279,467 | 4/1942 | Jones et al. | 226/92 |
| 2,944,345 | 7/1960 | Faeber | 226/92 X |
| 3,178,124 | 4/1965 | Trout et al. | 226/92 X |
| 3,679,300 | 7/1972 | Artelt | 226/92 X |
| 4,079,877 | 3/1978 | McAnespie et al. | 226/92 |
| 4,161,269 | 7/1979 | Kirkpatrick | 226/92 |
| 4,422,588 | 12/1983 | Nowisch | 242/66 X |

*Primary Examiner*—Stuart S. Levy
*Assistant Examiner*—Joseph J. Hail, III
*Attorney, Agent, or Firm*—Steinberg & Raskin

[57] ABSTRACT

Method and apparatus for conducting the end of a web from a machine roll or the like through a subsequent web processing arrangement, such as a reeling arrangement, along a path defined by web guiding members. The apparatus comprises a fetching and gripping arrangement for gripping the end of the web on the machine roll and around which the web is wrapped a desired number of turns, and a web end conduction member carried by a conveyor arrangement for conducting the web doubled over itself through the web processing arrangement, the web unwinding simultaneously both from the machine roll and from the fetching and gripping arrangement.

22 Claims, 6 Drawing Figures

METHOD AND APPARATUS FOR CONDUCTING THE END OF A WEB

BACKGROUND OF THE INVENTION

The present invention relates to methods and apparatus for conducting the end of a web from a machine roll or the like through a subsequent web processing arrangement, such as reeling means, along a path defined by web guiding members.

The conduction of an end of a web is presently carried out in arrangements wherein the end of the web is torn into a wedge shape whereupon it is conducted by end conduction apparatus through subsequent web processing arrangements, such as reeling means, e.g. in a carrying roll slitter onto carrying rolls. Thereafter, the wedge-shaped web end is removed and the longitudinally slit partial webs are wound around cores in a conventional manner prior to initiation of the reeling operation. This conventional procedure has the drawback that the conduction of the web is exceedingly slow and usually requires two or three operators since the end of the web must first be torn into a wedge shape, the reeling means run at a relative slow rate and the removal of the wedge-shaped end of the web is time consuming. Moreover, such conventional web conduction arrangements require auxiliary equipment such as air blowers, belts and the like.

SUMMARY OF THE INVENTION

Accordingly, it is an object of the present invention to provide new and improved methods and apparatus for conducting the end of a web.

Another object of the present invention is to provide new and improved methods and apparatus for conducting the end of a web wherein the web end conduction is faster and requires a fewer number of operators than conventional arrangements.

Briefly, in accordance with the present invention, these and other objects are obtained by providing a method wherein the end of the web is conducted from the machine roll through the reeling means at full width by gripping the end of the web on the machine roll and wrapping a desired number of turns of the web around driven fetching and gripping means. The web is then conducted in a doubled over fashion through the slitter or other subsequent web processing arrangement so that the web unwinds simultaneously both from the machine roll and from the driven fetching and gripping means.

The objects of the invention are also attained by providing web end conducting apparatus which include fetching and gripping means arranged to grip the end of the web on the machine roll and around which a desired number of turns of the web are wrapped, and a web end conduction member transported by conveyor means, the conduction member arranged to conduct the web in a doubled over form through the reeling means with the web unwinding simultaneously both from the machine roll and from the fetching and gripping means.

The method and apparatus of the invention provides significant advantages relative to the conventional technique described above. For example, the end of the web need not be torn into a wedge-shape so that the conduction of the web end at its full width can be accomplished at a significantly faster speed than has been possible heretofore. The speed of the web conducting procedure is also increased since the need to tear off the wedge-shaped end of the web, which is a time-consuming step, is avoided. The air blowers, belts and other auxiliary equipment required for guiding the web can also be omitted. The method and apparatus of the invention also enable conduction of the web end to be accomplished by a single operator at a relatively high rate of speed. The invention also results in material savings since no paper broke is produced in view of the elimination of the need to form the web end into a wedge shape. Rather, the initial layers on the core are formed of a doubled web. These initial layers or courses form a "base" which are not usable in any event. For example, in letterpress applications, a layer having a thickness of about 10 mm must be left on the cores during unreeling since, for example, imperfections in the core surface generally give rise to tears in the web at the beginning of the reeling operation. In accordance with the invention, the initial part of the web is doubled over itself and is efficiently utilized as "waste" since there is no need to remove it on conclusion of the end conduction before rolling, as is done when the web end is wedge-shaped.

The preferred applications of the method and apparatus of the invention are those subsequent web processing arrangements in which the web end conduction time is long and labor intensive, such as coating machines, calenders and longitudinal slitters. The method of the invention can be applied both in topside as well as underside running arrangements.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
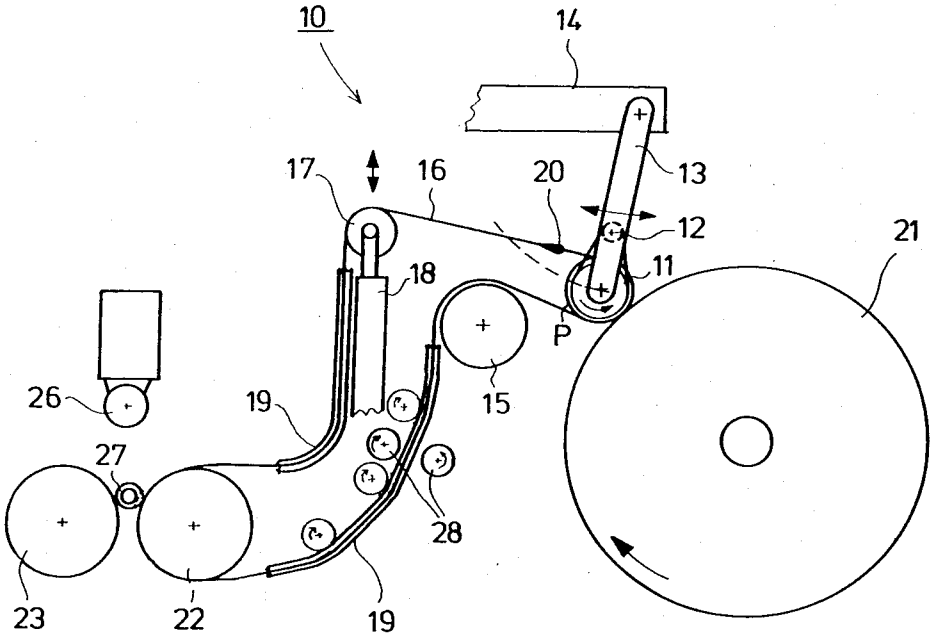
FIG. 1 is a side elevation view of an embodiment of apparatus in accordance with the invention for performing a method in accordance with the invention, and illustrating a condition wherein the web end has been fetched from a machine roll by fetching and gripping means and wherein the web has been wrapped around the fetching and gripping means a desired number of turns.

Referring now to the drawings wherein like reference characters designate identical or corresponding parts throughout the several views, and more particularly to FIG. 1, web end conduction apparatus, generally designated 10, are illustrated. In accordance with the illustrated embodiment, apparatus 10 comprises a suction roll 11 adapted to be driven by drive means 12. Suction roll 11 is rotatably mounted to the lower ends of fetching arms 13 whose upper ends are pivotally mounted to support structure 14 so that the suction roll 11 can be moved from a first position (FIG. 1) in association with machine roll 21 to a second running position (FIG. 2) through pivotal movement of fetching arms 13.

Figure 6:
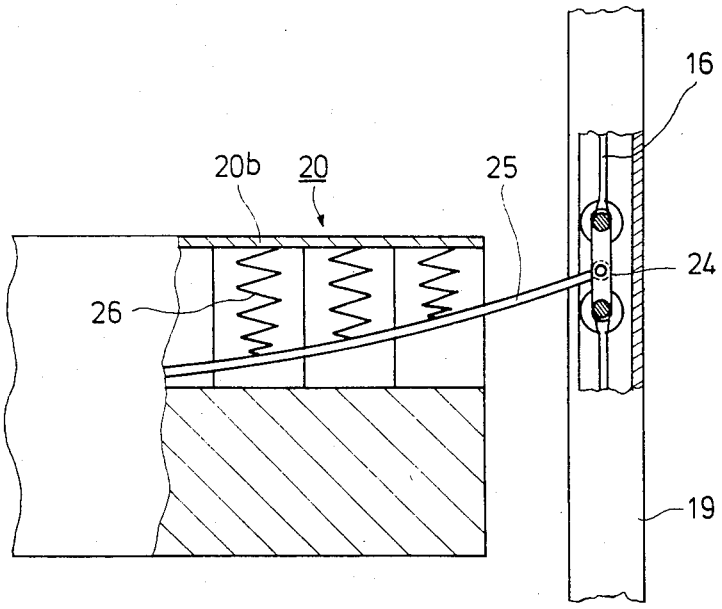
FIG. 6 is a partial sectional view illustrating the connection between the web end conduction rod and the conveyor means.

Apparatus 10 further includes a pair of endless transport chains 16, only one of which is seen in the figure, or other conveyor means for transporting a web end conduction rod 20 as described below. The transport chains 16 are situated at the respective longitudinal edges of the web and the conduction rod 20 extends transversely between them with the ends of the conduction rod 20 attached to respective chains 16 as shown in FIG. 6 and described in greater detail below. Chains 16 are arranged to transport the conduction rod 20 along a path which passes firstly between the suction roll 11 and the machine roll 21 and then between the suction roll 11 and a guide roll 15. Transport chains 16 are provided with drive means 17 and apparatus 18 for tensioning the same. A pair of guide rails 19 or the like are provided for guiding the path of the respective transport chain 16. Guide rails 19 preferably comprise rails having a C-shaped cross-section within which roller slides 24 (FIG. 6) of chain 16 move. It is understood that other conveyor means and guide rail constructions may be utilized within the scope of the invention. The movement of transport chains 16 are synchronized such as by means of an intermediate shaft or by a step motor drive.

Figure 2:
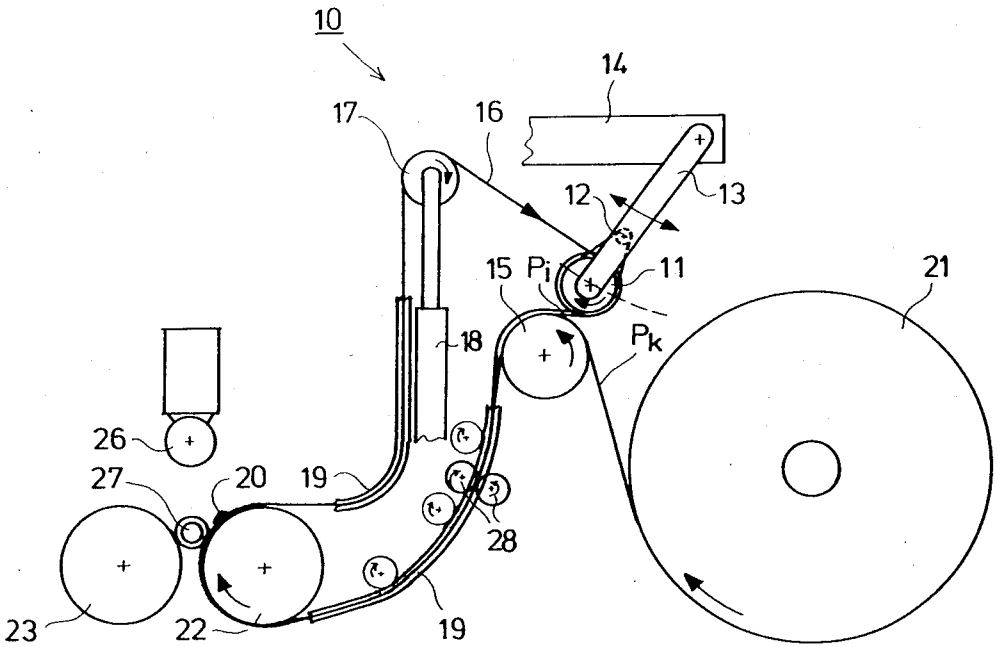
FIG. 2 is similar to FIG. 1 and illustrates a condition wherein the web end conduction rod transported by conveyor means, has conducted the web in a doubled over manner through the reeling means.

In the embodiment shown in FIGS. 1 and 2, the invention is applied in an arrangement where the web end is conducted from the machine roll to a longitudinal slitter including a rear carrier roll 22 and front carrier roll 23. The machine roll is designated 21 and the web being unwound from the machine roll is designated P.

Referring to FIG. 1, according to the method of the invention, the end of the web P is fetched by suction roll 11 from the machine roll 21. In the embodiment shown in FIG. 1 which constitutes an underside running arrangement, a suction roll 11 is in its first position contiguous with machine roll 21 and rotates in the direction of arrow A whereupon a number of turns of web P are wound around suction roll 11. The number of turns is determined by the length of web conduction taking into account a number of turns which are appropriate to prevent slippage of the web on the suction roll at the end phase of web end conduction. The end of the web P adheres to the shell of the suction roll 11 under vacuum or suction forces generated by the vacuum provided within the hollow, perforated shell of suction roll 11. A double-sided adhesive tape may be applied to the end of the web P to facilitate adherence of the end of the web P to the surface of the suction roll 11. Indeed, when adhesive tape is utilized, the use of a suction roll 11 is not absolutely essential and a solid surface roll may be substituted for suction roll 11. A conventional roll provided with adhesive tape may be used so that adherence of the end of the web P is assured.

After an appropriate number of turns of the web P have been wound on the suction roll 11, the suction roll 11 is moved by means of fetching arms 13 to a second end conduction and running position shown in FIG. 2. At this time, the transport chains 16 are driven in the direction of arrow B so that the suction roll 11 reverses its direction as indicated by arrow C. Drive means 12 of suction roll 11 applies a braking torque to the roll 11 so that the web P is maintained in a taut condition while the web unwinds from the suction roll 11. It should be noted that wrapping of the web on the suction roll 11 may be carried out in the second conduction and running position or during the movement of the suction roll 11 from the first fetching position to the second running position instead of while the suction roll 11 is in the first fetching position. In either of these alternative positions, the conduction of the end of the web P can be accomplished even faster. It will be understood that at least one or two turns of the web P must first be wound around the suction roll 11 to enable the web P to be moved into the second conduction and running position with suction roll 11.

Figure 4:
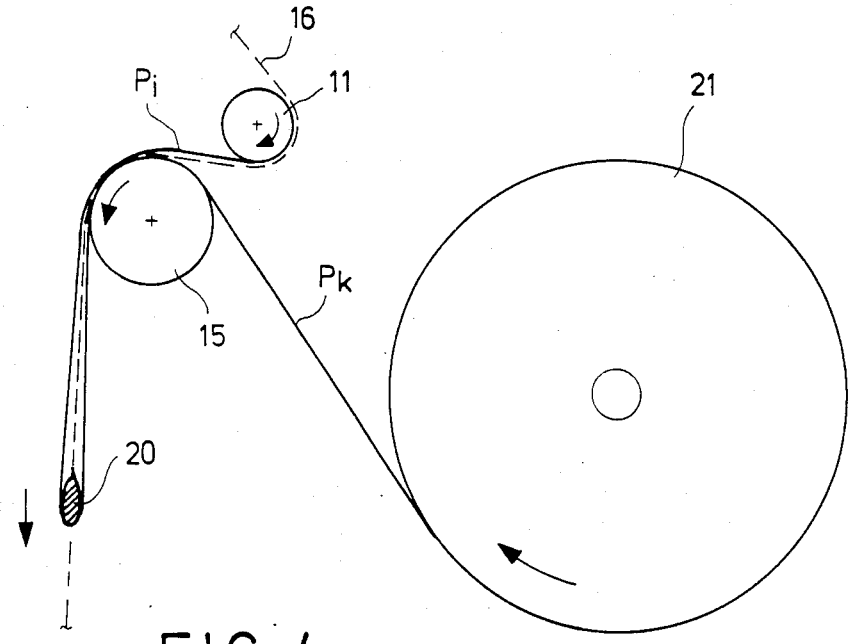
FIG. 4 is a view similar to FIG. 3 showing an application of the invention in underside running machines.

The conduction rod 20 is moved along with transport chains 16 in the direction of arrow B so that the conduction rod 20 moves around suction roll 11 and initially engages the length of the web P extending between machine roll 21 and suction roll 11. In this manner, the web P forms a loop around the conduction rod 20 as seen in FIG. 4. For purposes of clarity, the length of the web being unwound from the suction roll 11 is designated $P_i$ while the length of web being unwound from the machine roll 21 is designated $P_k$. Conduction rod 20 continues to be transported between suction roll 11 and guide roll 15 by chains 16 with the web P unwinding simultaneously both from the machine roll 21 and from the fetching and gripping roll 11. The transport of the looped or doubled over end of web P by conduction rod 20 continues guided by the lower (as seen in FIG. 2) guide rails 19 through the longitudinal slitter or other web processing arrangement.

Figure 5:
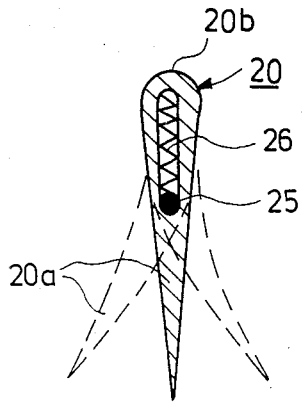
FIG. 5 is a cross-sectional view of a web end conduction rod forming a component of apparatus in accordance with the invention.

Referring to FIGS. 5 and 6, the ends of the conduction rod 20 are connected to the respective transport chains 16 by means of a cable 25 or similar elongated member having a high tensile strength. The ends of cable 25 are fastened to the roller slides 24 of respective chains 16. Since the conduction rod 20 is flexible and fixed at its ends, it tends to assume an undesirable catenary shape. In order to prevent this tendency, spring elements 26 are provided within the conduction rod 20 to maintain the leading edge **20*b* of the conduction rod 20 in a substantially linear configuration as seen in FIGS. 5 and 6. The spring elements 26 may, for example, be formed of elastic material or as coil springs, the spring constants of the respective spring elements varying in the longitudinal direction of the rod 20 as can best be understood from FIG. 6. Alternatively, the spring constants of spring elements 26** may be adjustable.

The guide rails 19 stretch the cable 25 of conduction rod 20 on its run between the suction roll 11 and the carrier roll 22 and 23. In the latter part of the run, a slighter stretch may be applied to the conduction rod.

As noted above, the doubled over web pulled by conduction rod 20 unwinds throughout the end conduction process both from the suction roll 11 and from the machine roll 21. A substantially constant tension is maintained in the web P over the entire run, the tension in the web P preferably being initially adjusted through suitable adjustment of the drive 12 of suction roll 11 and the drive apparatus 17 of the transport chains 16. As the end conduction process proceeds, the normal controls for the tension of the web P may be adjusted by controlling the unwinding of the machine roll 21 by means of a brake generator.

After the conduction rod 20 has reached a desired position above the carrier roll 22 and 23 as seen in FIG. 2, the machine roll 21 and suction roll 11 are stopped or their rotation slowed whereby the pull of the conduction rod 20 breaks the web P. The conduction rod 20 runs to its rest position close to the suction roll 11 so as to be in position for the next web end conduction.

The conduction rod 20 is sufficiently flat to enable it to be conducted between the cores and the carrier roll when the cores are located in the throat between the carrier roll 22 and 23. When the web P is wound around the cores, the additional equipment conventionally utilized is of course employed.

Web end conduction in accordance with the invention is also advantageously utilized in the manufacture of a factory splice or front joint in the paper on customer rolls. In this case, the relatively flat conduction rod 20 passes through the nip defined by the rear carrier roll 22 and the customer roll and thereby slightly lifts the line of rolls. The so-called creep speed may in such a case be selected to be such that no damage is caused to the roll.

As seen from the foregoing, in accordance with the method of the invention, the end of the web P is conducted in such a manner that the web P is doubled over throughout the conduction process. Such an arrangement is advantageous in that the pulling force exerted on the web by the conduction rod 20 may be higher than in the conventional case where only a single layer web is being pulled. As a result, the web P is not as likely to break if minor variations occur in the pulling force applied to it by conduction rod 20 or in the case where the tensile strength of the web is low.

As the conduction rod 20 travels past the cutting blades of the slitter, the blade pairs are separated. However, the cutting blades may be returned to their cutting position immediately after the conduction rod 20 passes so that only very small amounts of unslitted paper are produced and the possibility of the customer rolls hanging together is eliminated.

The conduction rod 20 is preferably somewhat flexible, i.e., not completely rigid, and sufficiently flat that it can pass through the gap between the carrier rolls 22 and 23 and between the cutting blades of the longitudinal slitter. As seen in FIG. 5, the cross-section of the leading edge of the conduction 20 is rounded so that tension loads are distributed as uniformly as possible over the web P. In order to prevent potential buckling, the trailing end of conduction rod 20 is provided with a flexible tail 20*a* as seen in FIG. 5. The sides of flexible tail 20*a* rests against the inner surfaces of the doubled-over web P so that it is not possible for the rod 20 to flip over during the pulling operation.

Figure 3:
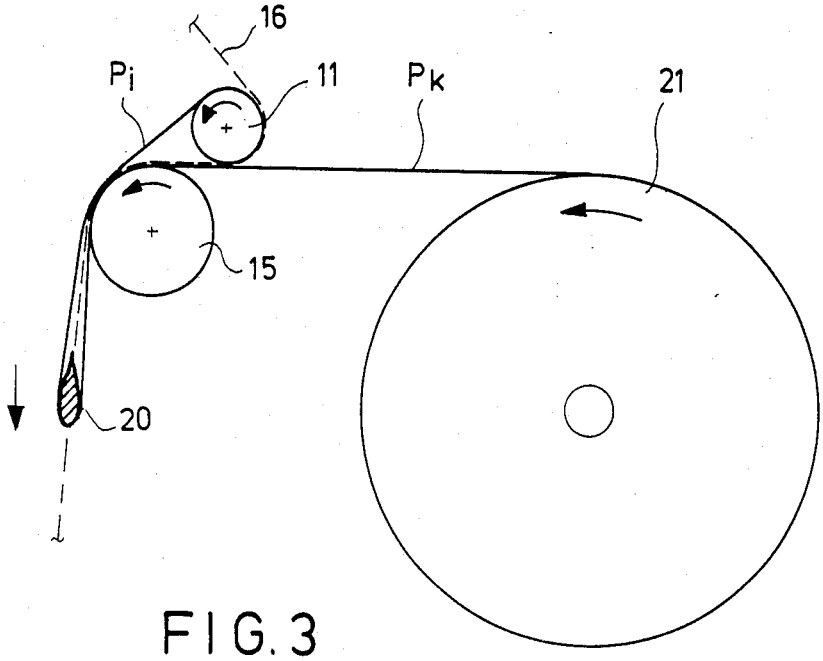
FIG. 3 is an elevational detail view illustrating the application of a method and apparatus in accordance with the invention in topside running machines.

As noted above, the invention is illustrated in FIGS. 1, 2 and 4 in connection with an underside running arrangement. A topside running arrangement is illustrated in FIG. 3 wherein the web unwinds from the machine roll 21 from the top as indicated by $P_k$. The direction of rotation of the machine roll 21 and suction roll 11 are shown by the arrows in FIG. 3. The web unwinds from the top of the suction roll 11 which rotates in the direction shown by the arrow in FIG. 3.

During underside running, the web unwinds from the bottom of the machine roll 21 as shown in FIG. 4 at $P_k$. The machine roll 21 and the suction roll 11 rotate in opposite directions to those shown in FIG. 3. During underside running, the web $P_i$ unwinds from the suction roll 11 from its bottom. The direction of rotation of the guide roll 15 is the same both in topside and underside running.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for conducting an end of a web from a machine roll through a subsequent web processing arrangement along a path defined by web guiding members, comprising the steps of:

gripping the end of the web on fetching and gripping means;

wrapping the web around the fetching and gripping means a desired number of turns;

engaging and then conducting the web in doubled-over form through the web processing arrangement with the web unwinding simultaneously both from the machine roll and from the fetching and gripping means.

2. The method of claim 1 wherein said gripping and wrapping steps are performed with said fetching and gripping means being situated in a first gripping position and then moving said fetching and gripping means to a second running position.

3. The method of claim 1 wherein said gripping step is performed with said fetching and gripping means situated in a first gripping position and wherein said wrapping step is performed as said fetching and gripping means are being moved from said first gripping position to a second running position.

4. The method of claim 1 wherein said gripping step is performed with said fetching and gripping means being situated at a first gripping position and wherein prior to said wrapping step, said fetching and gripping means are moved to a second running position.

5. The method of claim 1 wherein the web is conducted in doubled-over form by conveyor means through the subsequent web processing arrangement along a controlled path.

6. The method of claim 1 wherein upon the web being conducted in doubled-over form reaching a preselected position, stopping or slowing said machine roll and fetching and gripping means causing the web to break.

7. The method of claim 1 wherein while the web is unwinding simultaneously from the machine roll and from the fetching and gripping means, controlling the tension of the web.

8. The method of claim 1 wherein in said gripping step, the end of the web is adhered to the fetching and gripping means by suction.

9. The method of claim 1 wherein in said gripping step, the end of the web is adhered to the fetching and gripping means by adhesive.

10. Apparatus for conducting an end of a web from a machine roll through a subsequent web processing arrangement along a path defined by web guiding members, comprising:

fetching and gripping means for gripping the end of the web on the machine roll and for wrapping the web therearound a desired number of turns;

conduction means for engaging the web and conducting the web in doubled-over form through the web processing arrangement with the web unwinding simultaneously both from the machine roll and from the fetching and gripping means; and means for conveying said conduction means along a controlled path.

11. The combination of claim 10 wherein said fetching and gripping means comprise a suction roll driven by drive means.

12. The combination of claim 10 wherein said fetching and gripping means comprise roll means for gripping the end of the web and around which the web is wound a desired number of turns and means on which said roll is mounted for moving said roll between a first gripping position proximate to the machine roll and a second running position.

13. The combination of claim 12 wherein said roll moving means comprise fetching arms at first ends of which said roll is mounted, said fetching arms being pivotally mounted at second ends thereof to support structure.

14. The combination of claim 10 wherein said conveying means comprise flexible members to which said conduction means are fixed and means for driving said flexible members.

15. The combination of claim 14 further including means for tensioning said flexible members.

16. The combination of claim 14 wherein said flexible members are arranged to travel in a closed path and further including guide rail means for guiding the run of said flexible members.

17. The combination of claim 10 wherein said conduction means conveyed by said conveying means are arranged to break the web upon reaching a desired position at the subsequent web processing arrangement whereupon the machine roll and fetching and gripping means are stopped or slowed.

18. The combination of claim 10 wherein said conduction means comprise an elongate, substantially flat rod member.

19. The combination of claim 18 wherein subsequent web processing arrangement comprises a longitudinal slitter including carrier rolls having a gap between them and cutting blades and wherein said conduction rod member passes through said gap between said carrier rolls.

20. The combination of claim 18 wherein said conduction rod member has a flexible tail.

21. The combination of claim 18 wherein said conduction rod member has a leading edge and includes spring means for maintaining said leading edge substantially straight.

22. The combination of claim 18 wherein cable means pass through said conduction rod member, said cable means being attached to said conveying means.

* * * * *